United States Patent [19]

Ingram

[11] Patent Number: 4,765,500

[45] Date of Patent: Aug. 23, 1988

[54] CONTAINER MADE FROM IDENTICAL HALVES

[76] Inventor: Margaret A. Ingram, 4635 Arriba Dr., Tarzana, Calif. 91356

[21] Appl. No.: 113,994

[22] Filed: Oct. 29, 1987

[51] Int. Cl.[4] ..... B65D 11/02; B65D 43/10

[52] U.S. Cl. ..... 220/4 E

[58] Field of Search ..... 220/4 B, 4 E, 260, 306

[56] References Cited

U.S. PATENT DOCUMENTS 3,032,228 5/1962 Andrews ..... 220/4 E 3,982,651 9/1976 Braun et al. ..... 220/4 E

*Primary Examiner*—George T. Hall

*Attorney, Agent, or Firm*—John J. Posta, Jr.

[57] ABSTRACT

The container is preferably a rectangular box or cube and includes a central storage space defined by an identical pair of mating portions. Each portion includes a flat bottom wall, a spaced pair of parallel vertical endwalls bearing upraised integral ears of a width less than the remainder of the endwall. The ears may be rectangular, semi-circular, triangular or another shape. A spaced pair of parallel vertical sidewalls interconnect the bottom wall and endwalls to define the central space, have upper margins level with the bottom of the ears, and have recesses in the outer periphery thereof adapted to snugly slidingly releasably receive the ears and present an essentially continuous surface therewith. Thus, the ears of one portion are received in the recesses of the other portion when one portion is inverted over the other portion rotated 90° and then the two portions are slid together. The ears and recesses act as guides for joining the two portions together. When joined together, the two portions provide the container with a smooth continuous outer surface. The container can be in the form of a die used to contain solid perfume in the central space thereof, accessible by pulling the two portions apart but air sealed due to the configuration of the two portions.

11 Claims, 2 Drawing Sheets

CONTAINER MADE FROM IDENTICAL HALVES

BACKGROUND OF THE INVENTION

1. Field of the Invention

The present invention generally relates to containers and, more particularly, to a novel container having two identical mating portions.

2. Prior Art

Various types of containers have been proposed for containing such volatile items as perfumes, perfumed soaps and lotions and the like. A particular problem for such containers is to provide an attractive appearance while enabling the container to prevent evaporation of the perfume, lotion, etc. The container should also be easy to open and close tightly. Preferably, the portions of the container should be identical to enable the container portions to be utilizable separately, if desired.

Most containers have lids which differ drastically from the remainder of the container and are not separately useable. See, for example, U.S. Pat. Nos. 2,581,615, 2,046,133, 4,421,127, 4,518,092, 1,221,900 & 1,370,294, among others. U.S. Pat. No. 2,527,339 discloses a lid similar to the remainder of the container, but not separable and separately usable. Only U.S. Pat. No. 3,032,228 to Andrews discloses a container comprising two identical separable portions, each of which can be used separately. However, the Andrews container is of a single configuration, must be made thick walled to enable the two portions to be aligned properly and has other drawbacks, including an obvious tendency to leak air.

Accordingly, there remains a need for an improved type of container which can be made easily in a hermetically sealed form, is easy to open and close and has two identical portions, both of which are separately usable.

SUMMARY OF THE PRESENT INVENTION

The improved container of the present invention satisfies all the foregoing needs. The container is substantially as set forth in the Abstract. Thus, it includes two identical portions. Each portion has a horizontal bottom wall, vertical spaced endwalls bearing upraised ears of semi-circular, rectangular, triangular or another shape and interconnecting sidewalls bearing recesses which matingly slideably receive the ears when one portion is inverted over the other related 90° and then the portions are slid together.

The recesses are backed by vertical sidewall portions in the recesses so that the ears and recesses form an alignment guide and hermetic sealing means for the container.

The central recess provided in the container can contain a perfume or other volatile safely without danger of evaporation. Moreover, when the two portions of the container are separated, each can be used as an open topped container. The container is inexpensive, durable, positive locking and of attractive appearance.

Further features of the invention are set forth in the following detailed description and accompanying drawings.

DRAWINGS

DETAILED DESCRIPTION

FIGS. 1-5

Figure 1:
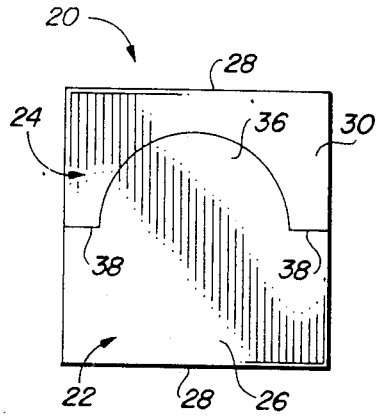
FIG. 1 is a schematic end view of a first preferred embodiment of the improved container of the present invention.
Figure 2:
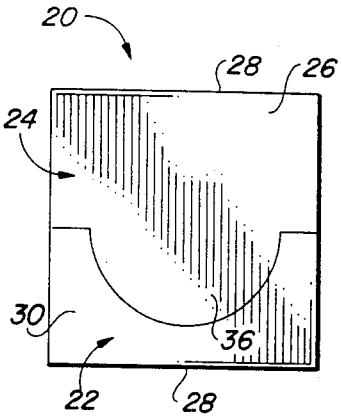
FIG. 2 is a schematic side elevation of the container of FIG. 1.
Figure 3:
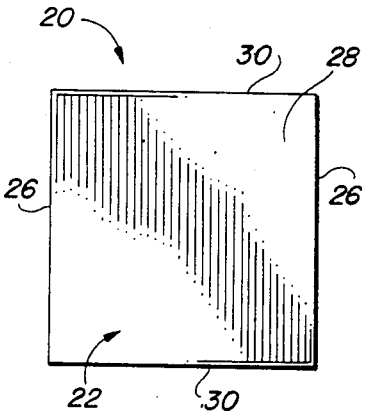
FIG. 3 is a schematic bottom plan view of the container of FIG. 1.
Figure 4:
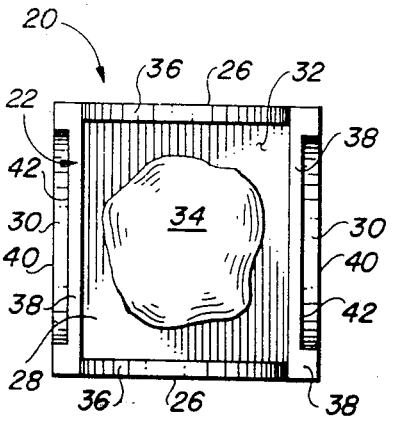
FIG. 4 is a schematic top plan view of the container of FIG. 1 with the top one of the two portions thereof removed and with a lump of solid perfume disposed therein.
Figure 5:
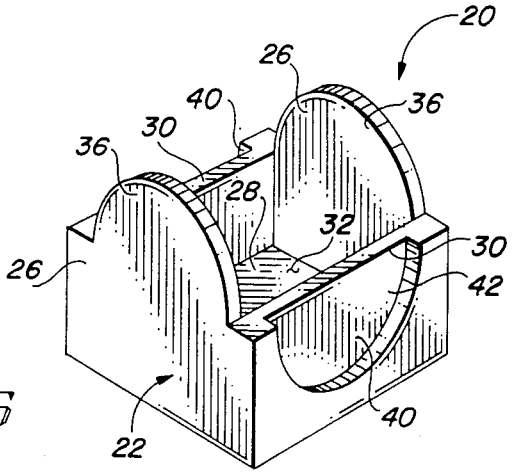
FIG. 5 is a schematic perspective view of the bottom portion of the container of FIG. 1.
Figure 6:
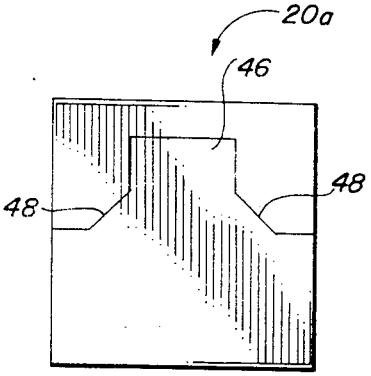
FIG. 6 is a schematic end view of a second preferred embodiment of the improved container of the present invention.
Figure 7:
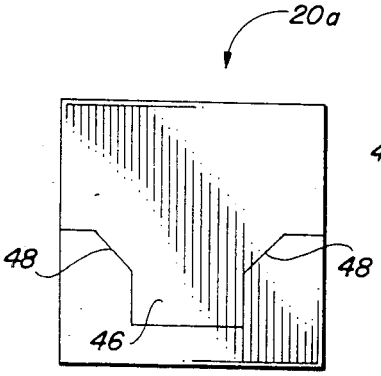
FIG. 7 is a schematic side elevation of the container of FIG. 6.
Figure 8:
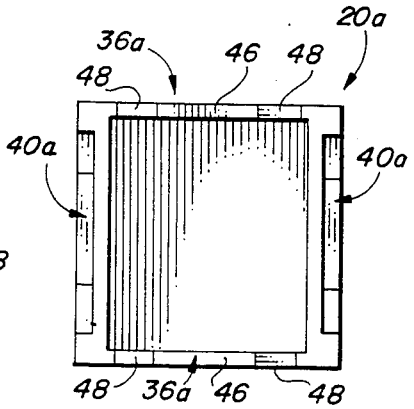
FIG. 8 is a schematic top plan view of the container of FIG. 6 with the upper portion thereof removed.
Figure 9:
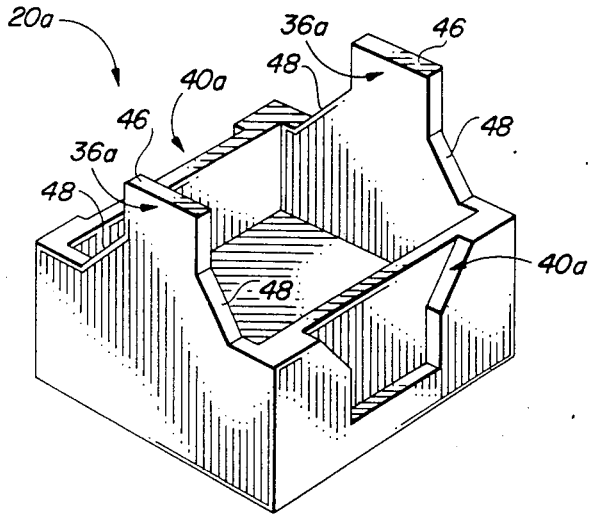
FIG. 9 is a schematic perspective view of the lower portion of the container of FIG. 6.

Now referring more particularly to FIGS. 1-5, a first preferred embodiment of the improved container of the present invention is schematically depicted therein. Thus, container 20 is shown, which comprises two identical portions 22 and 24. Upper portion 24 is inverted over and rotated 90° and then releasably joined to lower portion 22.

Each portion includes a spaced pair of parallel vertical endwalls 26, a horizontal bottom wall 28 (which in the inverted portion 24 is a top wall for container 20) and a spaced pair of parallel vertical sidewalls 30 interconnecting walls 26 and 28 of each portion 22 and 24 to define a central space 32 within which a ball or lump of solid waxy perfume 34 or the like may reside.

Each of endwalls 26 has a vertical integral ear 36 projecting upwardly from the upper portion thereof and centered relative to the sides thereof. Ear 36 is of less width than the remainder of endwall 26 so that a horizontal shelf 38 is provided on each side thereof.

In the embodiment of FIGS. 1-5, ears 36 are simi-circular. Other shapes are also useful. The ears 36 of one of the portions 22 and 24 are slideably releasably received within closely mating recesses 40 of essentially the same shape and size in the upper ends of sidewalls 30 of the other of portions 22 and 24. Similar mating occurs for the other of portions 22 and 24, as can be seen from FIGS. 1 and 2. The tops of sidewalls 30 in each portion 22 and 24 are at the level of the bottom of ears 36 of that portion.

When the ears 36 of each portion are seated within the recesses 40 of the other portion, space 32 is hermetically sealed to prevent evaporation of perfume 34. In such position, shelves 38 of the two portions 22 and 24 tightly abut each other to enhance the seal.

Moreover, since recesses 40 do not extend all the way through sidewalls 30, that is, are not openings, the vertical portions 42 of sidewalls which block recesses 40 act as slide guides for ears 36, aiding the aligning of portions 22 and 24 and the sealing of them together.

It will be noted that when portions 22 and 24 are fully separated, each form an open topped container which can be used separately. Because portions 22 and 24 are identical, they can be used with either one of them on top, as desired. Moreover, a single molding die can be used to form each from plastic, metal or the like, thus saving manufacturing costs.

In addition, because recesses 40 closely conform to ears 36 in size and shape, container 20 when assembled presents a smooth continuous set of surfaces for improved novel appearance. Container 20 is inexpensive, durable and useful.

FIGS. 6–9

A second preferred embodiment of the improved container of the present invention is schematically depicted in FIGS. 6–9. Thus, container **20*a* is shown. Components thereof similar to those of container 20 bear the same numerals, but are succeeded by the letter "a". Container 20*a* is identical to container 20 in all respects, except that ears 36*a* have generally rectangular upper portions 46 and sloping angled bases 48, while recesses 40*a* are shaped to mate therewith. Container 20*a* is similar to container 20** in properties and advantages.

FIGS. 10–12

Figure 10:
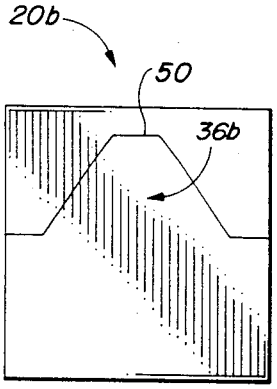
FIG. 10 is a schematic end view of a third preferred embodiment of the improved container of the present invention.
Figure 11:
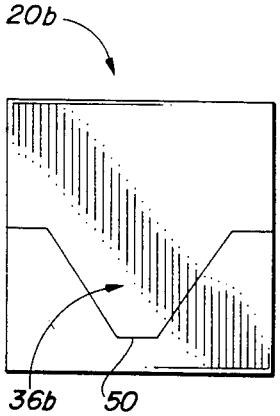
FIG. 11 is a schematic side elevation of the container of FIG. 10.
Figure 12:
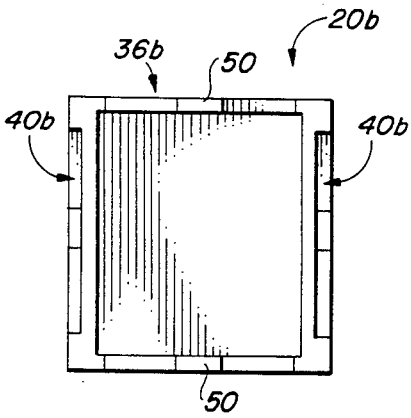
FIG. 12 is a schematic top plan view of the container of FIG. 10, with the upper portion thereof removed.

A third preferred embodiment of the improved container of the present invention is schematically depicted in FIGS. 10–12. Thus, container **20*b* is shown. Components thereof similar to those of container 20 or 20*a* bear the same numerals, but are succeeded by the letter "b". Container 20*b* is identical in all respects to container 20, except that ears 36*b* have a generally triangular configuration, with a flat top 50. Recesses 40*b* have a mating configuration. Container 20*b* has the advantages of containers 20 and 20*a***.

FIGS. 13–15

Figure 13:
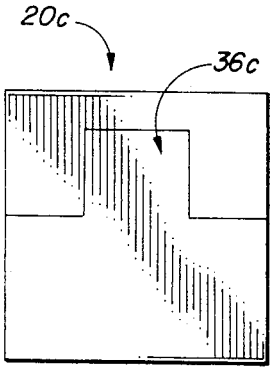
FIG. 13 is a schematic end view of a fourth preferred embodiment of the improved container of the present invention.
Figure 14:
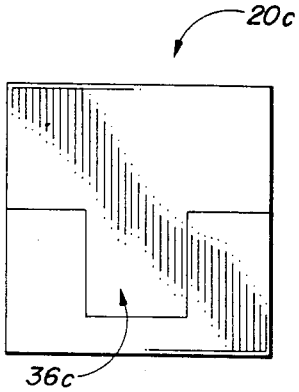
FIG. 14 is a schematic side elevation of the container of FIG. 13.
Figure 15:
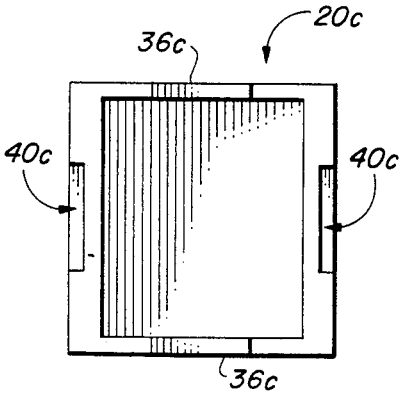
FIG. 15 is a schematic top plan view of the container of FIG. 13, with the upper portion thereof removed.

A fourth preferred embodiment of the improved container of the present invention is schematically depicted in FIGS. 13–15. Thus, container **20*c* is shown. Components thereof similar to those of any of containers 20, 20*a* and 20*b* bear the same numerals, but are succeeded by the letter "c". Container 20*c*. is identical in all respects to container 20, except that ears 36*c* are rectangular as are mating recesses 40*c*. Container 20*c* has the advantages of containers 20, 20*a* and 20*b*.**

Various other modifications, changes, alterations and additions can be made in the improved container of the present invention, its components and parameters. All such modifications, changes, alterations and additions as are within the scope of the appended claims form part of the present invention.

PRIOR ART STATEMENT

A preliminary patentability search has been conducted on the subject matter of the present application. The following references were located, one copy of each of which is enclosed herewith: U.S. Pat. Nos.

1,370,294—Dumons
1,221,900—Palmer
2,527,339—Tamoschat
2,581,615—Whitelaw
2,046,133—Rathbun
4,421,127—Geer
4,518,092—Contreras, Sr.
3,032,228—Andrews Only Andrews is of any relevance whatsoever. Only Andrews discloses a container having semi-circular ears. However, the present invention is clearly patentable thereover for a number of reasons, including the fact that the ears of the present container are releasably received within recesses, not openings in the sidewalls of the container. The recesses extend only part way through the sidewalls and thus are backed by the sidewall in the recesses so that integral aligning guides are thus provided for the two identical mating portions of the container. Moreover, the container is rectangular or a cube and the ears may be rectangular, triangular or another shape. The container can be hermetically sealed. Accordingly, the present invention is clearly patentable over Andrews.

What is claimed is:

1. An improved openable container, said container comprising identical mating first and second portions, each said mating portion including:

(a) a flat bottom wall;

(b) a pair of spaced parallel vertical endwalls, the upper ends of which form identical integral upraised ears of a width less than the width of the remainder of said endwall; and, (c) a pair of spaced parallel vertical sidewalls interconnecting said bottom wall and said endwalls, to collectively define a central storage space, the upper margin of said sidewalls being at the level of the lower end of said ears, said sidewalls having recessed in the outer priphery thereof extending only part way through said sidewalls and adapted to snugly receive said ears of said portions when said second portion is inverted and mated with said first portion, said central storage space being releasably sealed by said mating of said first and second portions, said portions being rotated 90° relative to each other in the mated state.

2. The improved container of claim 1 wherein said container is a generally rectangular box.

3. The improved container of claim 1 wherein said container is a cube.

4. The improved container of claim 1 wherein only one of said ears is disposed in each said endwall and is centered on said endwall and wherein when said two portions are joined together, the outer surfaces of said ears are essentially continuous with the outer surface of said sidwalls providing said container with a continuous outer surface.

5. The improved container of claim 5 wherein said ears are generally semi-circular.

6. The improved container of claim 5 wherein said ears are generally triangular.

7. The improved container of claim 5 wherein said ears are generally rectangular.

8. The improved container of claim 7 wherein said ears have downwardly and outwardly sloping bases.

9. The improved container of claim 1 wherein said ears are slideably received in said recesses with inner surfaces of said ears slideably abutting outer surfaces of said sidewall in said recesses, whereby said recess outer surfaces act as aligning guides for said tabs when mating said two portions.

10. The improved container of claim 9 wherein said container is in the form of a plastic die containing a solid perfume in said central space.

11. The improved container of claim 9 wherein said tabs and recesses act as hermetic seals for said container so that said container can hold a volatile without substantial evaporation thereof.

* * * * *